United States Patent [19]

Lewis

[11] Patent Number: 4,934,611

[45] Date of Patent: Jun. 19, 1990

[54] ROTARY GRINDING APPARATUS

[75] Inventor: Herbert H. Lewis, Jacksonville Beach, Fla.

[73] Assignee: Newman Machine Company, Inc., Greensboro, N.C.

[21] Appl. No.: 391,468

[22] Filed: Aug. 9, 1989

[51] Int. Cl.[5] ..... B02C 13/31

[52] U.S. Cl. ..... 241/36; 241/191; 241/295

[58] Field of Search ..... 241/32, 36, 191, 295, 241/301

[56] References Cited

U.S. PATENT DOCUMENTS

| | | | |
|---|---|---|---|
| 1,606,035 | 11/1926 | Mitts | 241/32 |
| 2,869,797 | 1/1959 | Montgomery | 241/32 X |
| 3,473,742 | 10/1969 | Montgomery | 241/32 |

*Primary Examiner*—Timothy V. Eley

*Attorney, Agent, or Firm*—Bell, Seltzer, Park & Gibson

[57] ABSTRACT

Shear pins indirectly interconnecting breaker rings and shaft components of the rotor assembly of the apparatus are so located and mounted as to be readily replaceable when sheared by relative rotative movement between the components. Relative rotative movement of the components is detected and changes the operating condition of the drive motor and/or a signaling device associated with the apparatus.

14 Claims, 2 Drawing Sheets

ROTARY GRINDING APPARATUS

FIELD OF THE INVENTION

This invention relates to rotary grinding apparatuses, such as are used for grinding or similarly comminuting scrap material such as wood or other material, that include a rotor assembly having a plurality of laterally adjacent breaker rings which rotate in unison with each other during normal operation of the apparatus. The invention more specifically relates to means for minimizing down-time and possible damage of such an apparatus when a blockage or the like prevents rotation of one or more of the breaker rings in unison with the remainder of the rings.

BACKGROUND OF THE INVENTION

In many rotary grinding apparatuses, the annular breaker rings and the center shaft of the rotor assembly are interconnected by elongate shear pins located within bores that extend radially through the outer and inner circumferential surfaces of the breaker rings and a considerable distance into the center shaft of the rotor. Customarily a plurality (e.g., three) of such pins are associated with each breaker ring. A fourth radial bore containing a breakable cylinder of lubricant such as oil may also be provided in association with each breaker ring and the shaft. When a blockage within the apparatus prevents a breaker ring from rotating in unison with the shaft, the shear pins and oil cylinder associated with such ring break, permitting relative rotative movement between the shaft and ring. The released oil assists in preventing galling or other damage to the abutting and then relatively moving surfaces of the breaker ring and the shaft. Such damage is particularly like to occur when cessation of the breaker ring's rotation is not promptly detected, and the grinding apparatus continues in operation. When the malfunction is detected and operation of the apparatus is halted, new shear pins and a new oil cylinder must be substituted for the broken ones. Removal of the broken shear pins, and particularly the portions thereof located within the shaft of the apparatus, is frequently quite difficult. To facilitate their removal, the pins may be of an internally threaded tubular type adapted to receive an externally threaded tool. If a threaded connection can be established between the pins and the tool, which is not always the case, the tool may be used to attempt to pull the broken portion of the shear pins outwardly from the shaft. Alternatively or additionally, a smaller diameter shaft bore communicating and aligned with the inner end of that containing the shear pin may be provided for the purpose of receiving a set screw or other "jacking" device by which the broken shear pin may be pushed outwardly from the shaft. Even with the assistance of such devices, however, removal of the broken shear pins normally is a tedious and time-consuming task. Additionally, even after the broken shear pins are removed, difficulties may be encountered in aligning the substitute replacement pins with the bores in the rotor shaft, particularly if the bores have been damaged or if metal from the broken shear pins has been transferred onto the shaft during continued operation of the apparatus following breakage of the pins. The foregoing factors greatly increase the down-time and maintenance costs of the grinding apparatuses.

SUMMARY OF THE INVENTION

With the foregoing in mind, the present invention provides a rotary grinding apparatus wherein down-time of and damage to the apparatus, upon shear pin breakage, are minimized.

In accordance with one aspect of the invention, not all and preferably none of the breaker rings of the apparatus are pinned or similarly directly connected to the center shaft of the rotor assembly. Laterally adjacent ones of the breaker rings are connected to each other by readily accessible couplings having shear pins that extend generally parallel to the central axis of the rotor assembly and that are disposed closely adjacent outer peripheral surfaces of the breaker rings. One end portion of each shear pin is secured to one of the laterally adjacent breaker rings by a bracket that may be readily connected to and disconnected from such breaker ring. The other end portion of the pin is received within a bore of the other of the adjacent breaker rings, and preferably within a bushing removably mounted within such bore. A coupling of the aforesaid type preferably is also used to interconnect an annular end plate member upon the rotor shaft and a thereto adjacent one of the breaker rings.

In accordance with another aspect thereof, the present invention provides control means for detecting stoppage or significant retardation of the rotation of a breaker ring in unison with the remaining rings of the rotor. The control means preferably also automatically halts operation of the apparatus when such a condition occurs. This minimizes possible damage to the confronting surfaces of the rotor shaft and breaker ring due to heat generated by relative movement between them. The possibility of damage to such surfaces is additionally minimized by the fact that no metal from the broken shear pins can come into contact with the aforesaid surfaces. Additionally, in a preferred embodiment of the invention, a cylindrical bearing is provided between the confronting surfaces of the breaker rings and the rotor shaft.

DESCRIPTION OF THE PRIOR ART

U.S. Pat. No. 3,000,577 discloses a gyratory crusher having shearable threaded bolts interconnecting driving and driven members.

U.S. Pat. Nos. 1,761,083 and 4,077,573 disclose pulverizing and thresher apparatuses which include a rotor assembly having shearable components associated with the teeth of the rotor assemblies.

U.S. Pat. No. 3,726,405 discloses a rotary pulverizing or grinding apparatus having a shearable mounting component associated with the breaker bar or anvil of the apparatus.

DESCRIPTION OF THE DRAWINGS

A preferred embodiment of the invention is illustrated in the accompanying drawings in which.

DESCRIPTION OF THE PREFERRED EMBODIMENT

Figure 1:
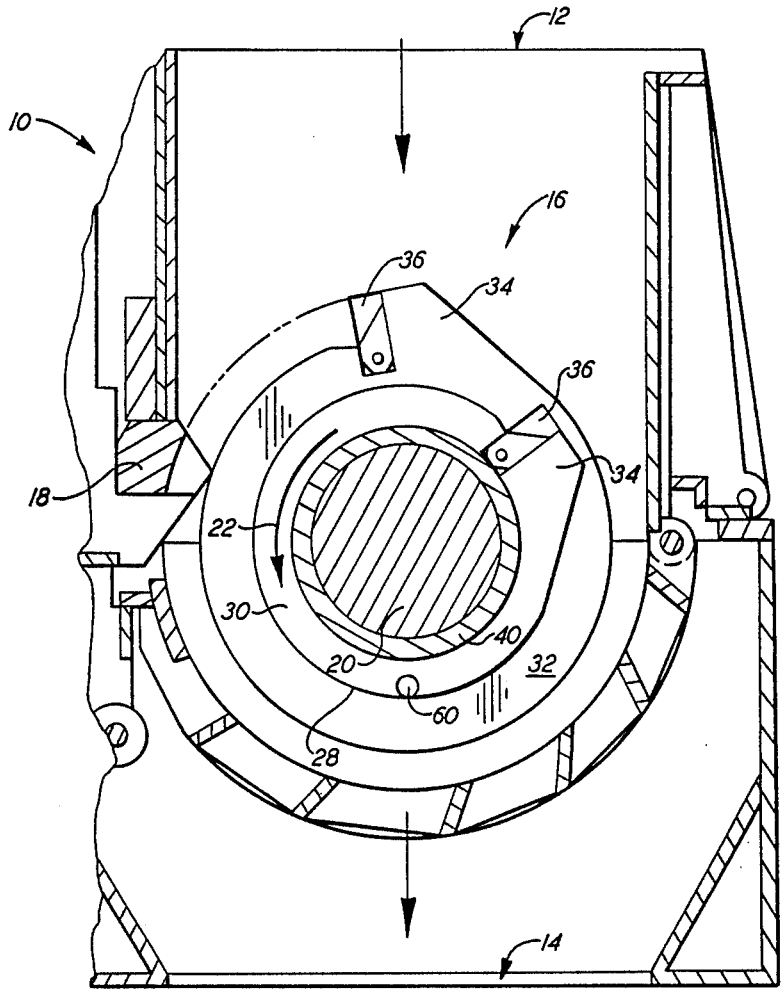
FIG. 1 is a fragmentary view, primarily in vertical section, of a rotary grinding apparatus having a rotor assembly in accordance with the invention.
Figure 2:
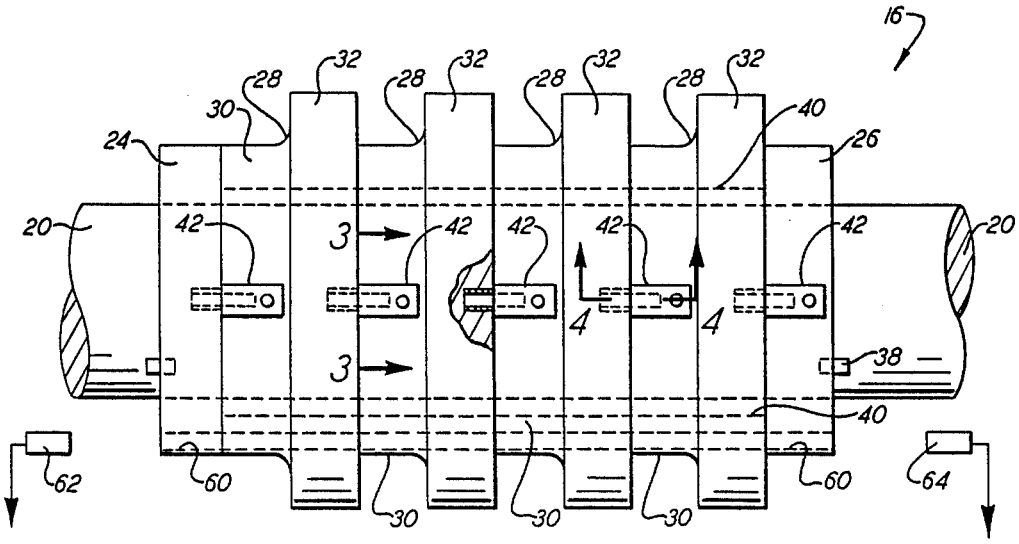
FIG. 2 is a fragmentary partially schematic plan view of the rotor assembly and of components of a sensor associated therewith.

Referring more particularly to the drawings, the numeral 10 in FIG. 1 designates a grinding apparatus having a scrap material inlet 12 and outlet 14 respectively disposed above and below a rotor assembly 16 with which a stationary anvil breaker bar 18 is associated. Rotor 16 includes a center shaft 20 that is mounted by suitable bearings (not shown) for rotative movement in the direction of the arrow 22 about its central axis, which movement is imparted to the shaft during operation of apparatus 10 by suitable drive means (not shown) connected thereto. Referring now also to FIG. 2 of the drawings, rotor assembly 16 further includes annular end plate members 24, 26, and a plurality of laterally adjacent annular breaker ring members 28. Each breaker ring 28 is illustratively of a known type having laterally adjacent small and large diameter portions 30, 32, respectively. Although not shown in the partially schematic drawing of FIG. 2, each portion 30, 32 of each breaker ring 28 has upon its outer circumferential surface a breaker head 34 and a breaker tooth 36 which, during operation of apparatus 10, pass closely adjacent breaker bar 18 and crush, cut or otherwise pulverize scrap material (not shown) introduced into apparatus 10.

End plates 24, 26 are secured directly to a shaft 20, as by means of keys 38 or similar means, for rotation in unison with the shaft at all times. Breaker rings 28 are not directly connected to rotor shaft 20, and preferably and illustratively are separated from the shaft by an intervening cylindrical bearing 40. Laterally adjacent ones of the end plate and breaker ring members 24, 26, and 28 are connected to each other by couplings 42 that are located adjacent the outer peripheral surfaces of such members and distal from rotor shaft 20.

Figure 3:
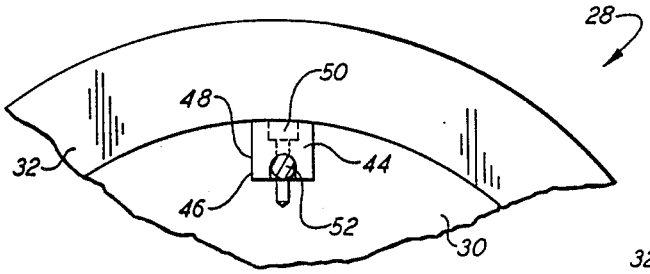
FIG. 3 is an enlarged fragmentary view taken substantially along the line 3—3 of FIG. 2.
Figure 4:
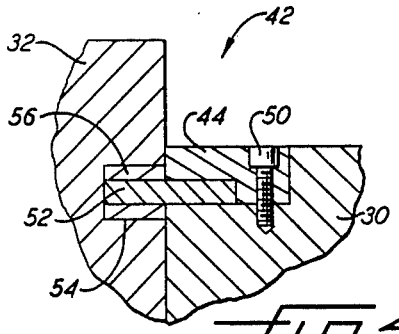
FIG. 4 is an enlarged fragmentary sectional view taken substantially along the line 4—4 of FIG. 2.
Figure 5:
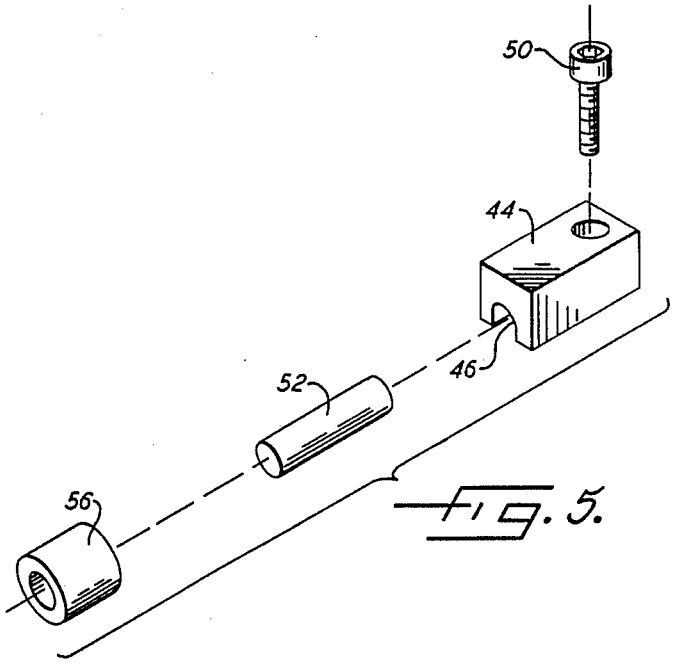
FIG. 5 is an exploded perspective view of one of the couplings shown in FIGS. 2 and 3.

As is best shown in FIGS. 3–5, each coupling 42 includes a generally rectangular bracket 44 having a longitudinally extending groove 46 opening from one of its ends and from its bottom surface. The bracket 44 of each coupling 42 interconnecting a laterally adjacent pair of breaker rings 28 is seated within a complementary recess 48 provided within the outer periphery of the small diameter portion 30 of one of the coupled breaker rings 28 and opening from the side of such breaker ring distal from its large diameter portion 32. Each coupling 42 is releasably secured within its recess 48 by a threaded bolt 50 or similar fastener capable of convenient insertion and removal, that extends through the coupling and into a threaded bore within the inner surface of the recess. Each coupling 42 further includes a breakable shear pin 52 that extends substantially parallel to the central axis of rotor assembly 16. One end portion of pin 52 is received within groove 46 of bracket 44, while the other end portion of the pin is received within a therewith aligned bore 54 provided within the confronting radially extending surface of large diameter portion 32 of the other breaker ring 28 of the coupled pair interconnected by coupling 42. Bore 54 preferably contains a removable hardened steel bushing 56 that also receives pin 52. At the right end (as viewed in FIG. 2) of rotor 16, coupling bracket 44 and recess 48 are located within the outer peripheral portion of end plate 26, rather than within a breaker ring 28. Similarly, at the leftmost end of rotor assembly 16, bore 54 and bushing 56 are within end plate 24, rather than within a breaker ring 28.

During normal operation of apparatus 10, couplings 42 of course cause breaker rings 28 to rotate in unison with each other and with shaft 20 and end plates 24, 26. If a blockage within apparatus 10 should prevent free rotation of one of the breaker rings 28 in unison with shaft 20, the pins 52 of the two couplings 42 associated with such ring will break when the shearing forces upon the pin reach a predetermined magnitude. Relative rotative movement will then occur between such breaker ring and shaft 20, and between such breaker ring and the annular end plate members 24, 26 thereon, since the member 28 with the broken shear pins 52 will stop rotating while the shaft and end plates continue their rotation. Relative rotation may and normally would also then occur between such breaker ring and other of the rings 28. However, if a coupling 42 were not provided between one of end plates 24, 26, e.g., end plate 26, and the adjacent breaker ring 28, shearing of the pin 52 of the coupling 42 associated with the other end plate 24 would result in cessation of rotation of all of the breaker rings 28.

When shearing of a pin 52 occurs, it can be quickly and easily replaced following removal of bolt 50 from the associated bracket 44 and removal of the bracket from the recess 48 within which it is seated. The magnitude of the force needed to effect shearing of pins 52 may be changed in a variety of ways. These include varying the number of coupling members 42 that interconnect each pair of laterally adjacent annular members upon shaft 20, and/or by substituting for the illustrated pins 52, brackets 44 and bushings 56, other pins 52 having a different diameter or shape and other bushings 56 and brackets 44 respectively having an internal diameter and a groove diameter commensurate with the different pin diameter.

As has been previously noted, stoppage or substantial retardation of rotation of any breaker ring 28 results in relative rotation between at least that breaker ring and shaft 20, but does not cause any damage to the confronting shaft and breaker ring cylindrical confronting surfaces since they are separated by bearing 40. However, when couplings 42 are provided at both ends of the array of breaker rings 28, as illustrated in FIG. 2, stoppage of the rotation of one of the breaker rings 28 may result in a generation of frictional heat between one or both side surfaces of the breaker ring and an adjacent end plate or breaker ring member. It is therefore desirable for relative movement between the annular members upon the shaft 20 to be promptly detected when it occurs. To this end, apparatus 10 preferably and illustratively further includes control means for detecting and signaling relative rotation between the annular members upon shaft 20, and for automatically stopping operation of apparatus 10 when such relative movement occurs. The aforesaid control means illustratively includes normally aligned bores that extend through each of the annular members 24, 26, 28 and that collectively define a passage 60 through which a beam of energy (e.g., light, infrared radiation, sonic signals) is directed from an energy emitter 62 to an energy receiver 64 (FIG. 2) at that time during each revolution of rotor 16 when passage 60 is aligned with sensor components 62, 64. Rotation of one of the breaker rings 28 relative to other of the annular breaker ring or end plate members upon shaft 20 blocks the transmission of energy from emitter 62 to receiver 64 through passage 60.

Figure 6:
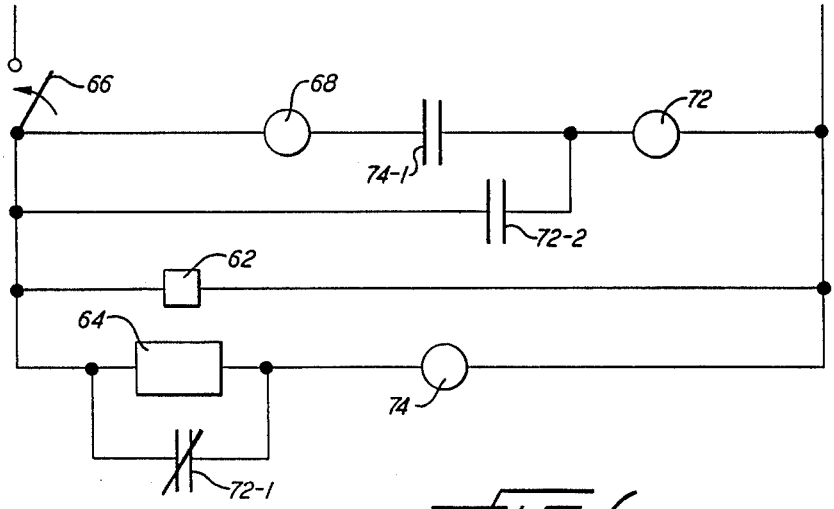
FIG. 6 is a schematic representation of sensor and control circuitry of the apparatus.

In addition to energy emitter and receiver 62, 64 the circuit of the control means schematically illustrated in FIG. 6 further includes master switch 66, a relay 68 that when energized activates the drive motor (not shown) of apparatus 10 and a lamp or other visual or audible signaling device (not shown), a time delay relay 72 having a normally closed contact 72-1 and a normally open contact 72-2, and a relay 74 having a normally open contact 74-1. Closure of manually operated master switch 66 energizes energy emitter and receiver 62, 64 and, via the circuit branch that includes normally closed relay contact 72-1, relay 74. Normally open relay contact 74-1 closes upon energization of relay 74, energizing relay 68 and time delay relay 72. Relay 68 then effects energization of the drive motor and signaling device (not shown) of apparatus 10. Energy receiver 64 is electrically conductive only when the frequency of the pulses of energy received by it indicate that apparatus 10 is operating properly at its preselected operating speed. After a period of time sufficient for apparatus 10 to reach such speed, timing-out of relay 72 causes opening of the relay contact 72-1 through which relay 74 was previously energized. Relay 74 then remains energized as long as the energy pulses received by device 64 continue to be of appropriate frequency. When relative rotation between two of the annular members upon rotor shaft 20 occurs, the energy pulses cease and device 64 becomes nonconductive. This deenergizes relay 74, causing opening of its contact 74-1. The ensuing deenergization of relay 68 causes cessation of the operation of the drive motor and signaling device (not shown) of apparatus 10. Relay 72 remains energized, via its contact 72-2 until opening of master switch 66. After this occurs, the circuit again occupies its condition illustrated in FIG. 6. Instead of controlling operation of both, it will be appreciated that relay 68 might control only the operation of either the drive motor or the signaling device (not shown) of apparatus 10.

While a preferred embodiment of the invention has been specifically shown and described, this was for purposes of illustration only, and not for purposes of limitation, the scope of the invention being in accordance with the following claims.

I claim:

1. Apparatus for grinding scrap material, comprising:

a housing adapted to receive said material;

a rotor assembly within said housing, said rotor assembly including a shaft rotated during operation of said apparatus about a central axis thereof, and a plurality of annular members mounted upon such shaft;

a coupling interconnecting first and second laterally adjacent ones of said annular members, said coupling including a shear pin extending laterally generally parallel to said axis between said first and second members, a removable bracket securing one end portion of said pin to said first of said members, the second of said members having a bore receiving the other end portion of said pin;

said coupling interconnecting said first and second members for rotation in unison with each other about said shaft axis while said pin is intact, and permitting relative rotation between said first and second members upon shearing of said pin.

2. Apparatus as in claim 1, and further including a cylindrical bearing encircling said shaft inwardly of said first and second members.

3. Apparatus as in claim 1, wherein said bracket of said coupling is located adjacent a circumferential surface of said first of said members, and further including a threaded fastener releasably securing said bracket to said first of said members.

4. Apparatus as in claim 3, wherein said first of said members has a recess within said circumferential surface thereof, and said bracket is received within said recess.

5. Apparatus as in claim 4, wherein said bracket has a groove opening from one end surface and from a bottom surface thereof, said groove of said bracket receiving said one end portion of said pin.

6. Apparatus as in claim 5, wherein said coupling further includes a cylindrical bushing within said bore of said second of said members, said other end portion of said pin extending into said bushing.

7. Apparatus as in claim 1, and further including sensor means for detecting relative rotative movement between one of said annular members and another of said annular members.

8. Apparatus as in claim 7, and further including control means for halting operation of said apparatus in response to detection by said sensor of relative rotative movement between said one of said annular members and said another of said annular members.

9. Apparatus as in claim 7, wherein said annular members include at least one end plate directly engaging and rotatable in unison with an end portion of said shaft, and a plurality of breaker rings.

10. Apparatus for grinding scrap material, comprising:

a housing adapted to receive said material;

a rotor assembly within said housing;

said rotor assembly including a shaft rotatable during operation of said apparatus about a central axis;

a plurality of annular members mounted upon said shaft at spaced locations along the length thereof for rotation therewith during normal operation of said apparatus;

sensor means for detecting relative rotative movement between said members; and means for halting operation of said apparatus in response to detection by said sensing means of said relative rotative movement between said members.

11. Apparatus as in claim 10, wherein said members have normally aligned bores extending therethrough; and said sensor includes means for directing a beam of energy through said bores.

12. Apparatus for grinding scrap material, comprising:

a housing;

a rotor assembly within said housing, said rotor assembly including a shaft rotated during operation of said apparatus about a central axis, an annular plate member and an annular breaker ring mounted upon said shaft, said plate member being secured directly to said shaft for rotation therewith, a coupling interconnecting said plate member and said breaker ring, said coupling including a shear pin extending generally parallel to said axis between said plate member and said breaker ring, said coupling being disposed distal from said shaft and adjacent outer peripheral surfaces of said plate member and said breaker ring.

13. Apparatus for grinding scrap material, comprising:

a housing adapted to receive said material;

a motor assembly within said housing;

said rotor assembly including a shaft rotatable during operation of said apparatus about a central axis;

a plurality of annular members mounted upon said shaft at spaced locations along the length thereof for rotation therewith during normal operation of said apparatus;

sensor means for detecting relative rotative movement between said members;

and signaling means for signaling said relative rotative movement between said members in response to detection thereof by said sensor means.

14. Apparatus as in claim 13, and further including means for interrupting operation of said apparatus in response to detection by said sensing means of said relative rotative movement between said members.

* * * * *

UNITED STATES PATENT AND TRADEMARK OFFICE

CERTIFICATE OF CORRECTION

PATENT NO. : 4,934,611

DATED : 19 June 1990

INVENTOR(S) : Herbert H. Lewis

It is certified that error appears in the above-identified patent and that said Letters Patent is hereby corrected as shown below:

Column 7, line 4, "motor" should read --rotor--.

Signed and Sealed this

Third Day of September, 1991

*Attest:*

HARRY F. MANBECK, JR.

*Attesting Officer*

*Commissioner of Patents and Trademarks*